United States Patent [19]

Ashworth-Jones

[11] Patent Number: 4,750,397

[45] Date of Patent: Jun. 14, 1988

[54] ELECTRONIC MUSICAL INSTRUMENT WITH ELASTOMERIC STRINGS AND SHIELDED BIMORPHIC TRANSDUCERS

[76] Inventor: Alun D. Ashworth-Jones, Le Nevek, Greenwith Hill, Perranwell Station, Truro, Cornwall, England

[21] Appl. No.: 897,388

[22] Filed: Aug. 15, 1986

[51] Int. Cl.[4] ..... G10H 3/18

[52] U.S. Cl. ..... 84/1.16; 84/173; 84/297 S; 84/DIG. 24

[58] Field of Search ..... 84/1.16, 173, 267, 297 R, 84/297 S, DIG. 24, DIG. 30

[56] References Cited

U.S. PATENT DOCUMENTS

| | | | |
|---|---|---|---|
| 2,593,990 | 4/1952 | Cristell | 84/297 R |
| 2,710,557 | 6/1955 | Sundt | 84/297 S |
| 3,712,951 | 1/1973 | Rickard | 84/DIG. 24 |
| 4,314,495 | 2/1982 | Baggs | 84/1.16 |
| 4,430,918 | 2/1984 | Meno | 84/1.16 |
| 4,491,051 | 1/1985 | Barcus | 84/1.16 |
| 4,635,518 | 1/1987 | Meno | 84/1.16 |

*Primary Examiner*—Stanley J. Witkowski

*Attorney, Agent, or Firm*—Gifford, Groh, VanOphem, Sheridan, Sprinkle and Dolgorukov

[57] ABSTRACT

A stringed musical instrument has a plurality of strings stretched between two fixed points and over a bridge. The strings are of substantially circular cross section and made from an elastomeric material such as silicone rubber; all strings are monolithic. The bridge incorporates one or more piezo-electric or other transducers each mounted as a bimorphic element in a simple beam mounting between fixed supports on the bridge and in acoustic contact with the body of the instrument through a resilient baffle pad in contact with the face of the piezo-electric element remote from the supports. That is, mounted in a manner in which the transducer can be considered to be a beam extending between load bearing or supporting members at its two ends, the fixed supports, while it is loaded transversely between its two ends by the baffle pad. By using elastomeric strings the length of the fingerboard of the instrument can be significantly reduced while nevertheless providing pitch values within a conventional musical range and a new depth of tone without requiring a large resonance chamber or long strings.

10 Claims, 2 Drawing Sheets

ELECTRONIC MUSICAL INSTRUMENT WITH ELASTOMERIC STRINGS AND SHIELDED BIMORPHIC TRANSDUCERS

BACKGROUND OF THE INVENTION

It is known for stringed electrical musical instruments to employ at least one transducer or pick-up sensitive to the vibrations of strings stretched over a bridge to generate electrical signals which can be amplified, and in some cases further modified, for reproduction. The majority of such pick-ups utilize electromagnetic transducers which necessitate that the strings be ferromagnetic, although piezo-electric transducers capable of producing electrical signals resulting solely from mechanical vibrations have been known. Typical examples of known such piezo-electric transducers for stringed musical instruments are discussed in British Pat. No. 1 524 833 and British Patent application No. 2 070 313. Various problems have been associated with known piezo-electric transducers; one such problem has been that of faithfully reproducing in the electrical signals the tonal qualities of the vibrating string of the musical instrument. U.S. Pat. No. 4,030,396 discloses one prior art attempt to so construct a pick-up for a stringed musical instrument incorporating a piezo-electric transducer that the electrical signal will reproduce faithfully, or more nearly faithfully, the tonal qualities of the original vibrating string.

In prior art stringed musical instruments the major factor influencing the necessary length of the vibrating strings are the modulus of elasticity of the material of which the string is made. This also influences the tension under which the string must be placed in order to vibrate at a given frequency in order to be able to obtain a desired range of pitch. In known musical instruments this tension, particularly when applied to four or six strings, has been sufficiently high as to make it necessary, at least in the case of instruments such as guitars, for the instrument neck, carrying the finger board or fretboard, to be reinforced with a metal rod to prevent bowing.

Although, by using rather thick and stiff strings, it has in the past been possible to generate notes in the lower register with instruments such as, for example, an electric bass guitar without a resonance chamber, instruments such as the double bass have still required a resonance chamber and rather long strings in order to produce the low notes required.

OBJECTS OF THE INVENTION

A primary object of the present invention is to provide an electrical musical instrument in which bass notes can be produced without a resonance chamber and using shorter strings than has heretofore been the case. Another object of the invention is to provide a new instrument with monolithic strings and novel tonal and playing qualities.

A further object of the present invention is to provide a stringed musical instrument in which it is possible to generate such low notes as were previously only produced from a large instrument such as the double bass, using an instrument of small dimensions, the vibrations of the strings of which are detected by electro-acoustic transducers and suitably amplified.

Still another object of the present invention is to provide an instrument in which reinforcement of the neck, such as by means of a steel rod, is not necessary, thereby making the instrument both light in weight as well as small in scale.

SUMMARY OF THE INVENTION

According to one aspect of the present invention, therefore, a stringed musical instrument having one or a plurality of strings stretched between a first point at one end of the string and a tension-adjusting mechanism at the other end thereof and passing over a bridge incorporating one or more piezo-electric transducer elements for converting mechanical vibrations of the strings into electrical signals is characterized in that the string or strings is or are composed of an elastomeric material and the transducer element or elements are not in direct mechanical contact therewith.

Although the present invention will be described hereinbelow with specific reference to its application to guitars and like such instruments it is to be understood that no loss of generality is to be engendered thereby and that the present invention is equally applicable to any instrument employing vibrating strings and includes such instruments as the harp, banjo, dulcimer and even the piano, harpsichord or like such encased stringed instruments.

Preferably the string or strings have a substantially circular cross-section. This latter term includes octagonal, hexagonal and elliptical sections but excludes flat band or strip-like strings as used on children's instruments in place of proper strings.

By using an elastomeric material of the above-defined cross-sectional shape in place of the conventional steel or nylon materials used for musical instrument strings (which are only of circular section), it is possible to generate notes of the required register without placing the strings under the very high tension which has previously been unavoidable. The use of such low tension is also made possible by employing a highly sensitive piezo-electric transducer fitted into the bridge to detect the vibrations of such strings. Conversely, such a delicate and sensitive transducer can only be used in an arrangement where it is not subjected to the high forces exerted due to the high tension of a conventional stringed instrument and thus the present invention favours this also. It is to be noted that typically the modulus of elasticity of steel is in the region of $20\times10^{11}$ dynes/cm$^2$ whilst the modulus of elasticity of elastomeric materials may be a factor of $10^9$ less than this and tests conducted on a practical instrument constructed in accordance with the present invention have demonstrated that strings having a modulus of elasticity in the region of between 5 and $15\times10^2$ dynes/cm$^2$ can produce very acceptable results comparable to a bass guitar or even to a double bass.

In a preferred embodiment of the invention the length, diameter and material of the strings are chosen such that the tension in the or each string does not exceed a few kg when the string is tuned to the required pitch and typically, the tension exerted by all four strings of an instrument tuned as a bass guitar would be in the region of up to 10 kg.

In prior art instruments the strings intended for producing the lower notes are of composite construction, incorporating a central elongate core around which is wound a winding of steel or other metal the properties of which are such as to modify the vibrating characteristics of the string, in particular to damp out the higher harmonics and to stiffen the string such that it vibrates with a low fundamental and in the lower harmonics only. In the stringed instrument of the present invention, however, such composite string structures are unnecessary and, even for the lowermost notes, it is sufficient to use strings which are each composed of an homogeneous monolithic element. This not only simplifies the string manufacturing techniques but also economizes on the cost of replacement strings should these become necessary after an extended period of use.

Typically, the diameter of the strings for the stringed instrument of the present invention may lie in the range of 1.5–6 mm when unstressed. Because elastomeric material having a very low Young's modulus is used the diameter of the string will, of course, be substantially modified when placing it under tension, and a diameter reduction in excess of 50 percent has in some cases been observed using the elastomeric materials described hereinbelow.

Another advantage accruing from the use of elastomeric strings lies in the fact that a range of low notes can be produced using strings very much shorter than has heretofore been found necessary. Indeed, an electrical musical instrument capable of producing notes having a pitch corresponding to that of a bass guitar or a double bass can be produced using strings having a length, between the bridge and the fixed stop of the nut no greater than 0.45 m.

It is preferred that the pick-up includes one or more piezo-electric transducers of a bimorphic type housed in a casing which is capable of accommodating the stresses of string tension while nevertheless acoustically coupling the transducer to the strings via appropriately formed acoustic transmission elements. Such an arrangement makes the use of highly sensitive, delicate transducers possible without the risk of damage. Previous piezo-electric transducers have required relatively high tension in the strings and have been specifically adapted to operate at such high tension. By using a bimorph structure it has been made possible to detect vibrations of relatively low energy due to the greater sensitivity of such a structure.

Other features and advantages of the invention will become apparent from a study of the following description, in which reference is made to the accompanying drawings.

DESCRIPTION OF THE PREFERRED EMBODIMENTS

Figure 1:
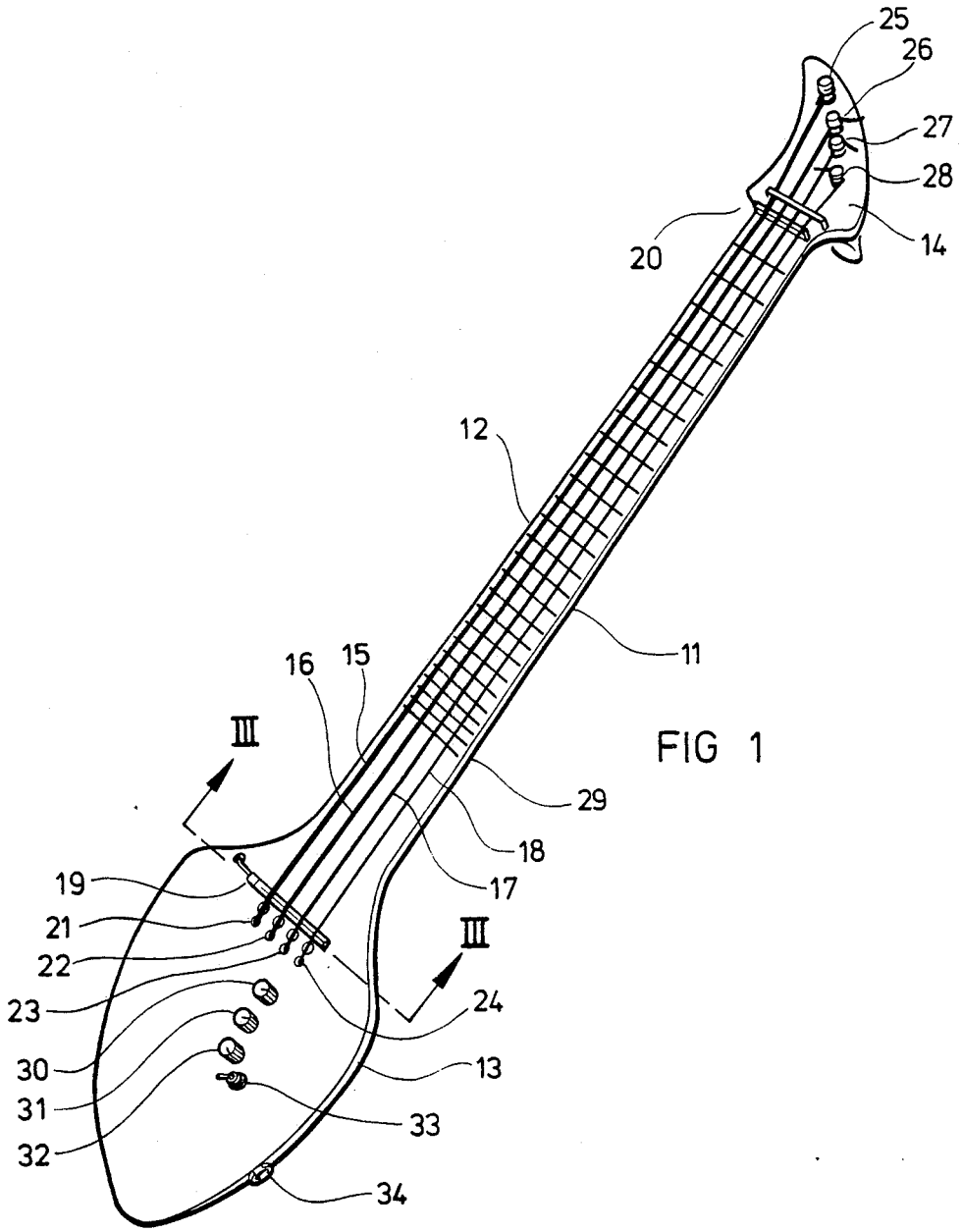
FIG. 1 is a perspective view of an instrument formed as an embodiment of the invention.

Referring first to FIG. 1 there is shown a stringed musical instrument structured as a bass guitar generally indicated 11 and comprising a neck 12 extending from a rudimentary body 13 to a headstock 14. As discussed above, the invention is equally applicable to other types of musical instrument.

In the illustrated instrument four strings 15, 16, 17 and 18 are stretched along the neck 12 between a bridge 19 and a fixed neck stop or nut 20. The strings 15–18 are anchored to the body 13 by passing through appropriate apertures 21, 22, 23, 24 and are secured at the headstock 14 on capstan-type tension adjusting members 25, 26, 27, 28 which because of the relatively low tension and elasticity in the strings, do not require the complex worm screw and worm wheel arrangement conventionally used on stringed musical instruments such as the guitar, but may be no more than friction pegs.

The neck 12, between the bridge 19 and the nut 20, has a length of about 0.45 m and, because of the low tension applied by the strings, can be made from a monolithic lightweight element such as wood or plastics without requiring any reinforcement such as the steel rods which have been used in prior art instruments. Moreover, the neck 12 of the instrument does not require fret bars as have heretofore been required for guitars in order to define the two end points of the vibrating string since the pressure of a player's finger on the string, pressing it to the finger board, is sufficient to "stop" the string at the appropriate point. Although frets as such are not required it may be found convenient, as illustrated in FIG. 1, to provide the finger board with a plurality of markings indicating the position of the fingers when stopping the appropriate notes.

The strings 15–18 of the instrument illustrated in FIG. 1 are made from a silicone rubber elastomer and the unstressed diameters of the strings 15,16,17 and 18 are 3 mm, 2.64 mm, 2.4 mm and 1.78 mm respectively. The strings 15–18 can be tuned to the notes E A D and G by applying a tension in the region of 45 gms, 55 gms, 60 gms and 70 gms respectively with a 0.38 m scale length (that is the length from the neck stop or nut 20 to the highest fret position indicated at 29 in FIG. 1.

On tests conducted on the strings described above the relation between the extension and the applied load is given by the following table:

| | | | | |
|---|---|---|---|---|
| String Diameter | 3 | 2.64 | 2.4 | 1.78 |
| Natural length (cm) | 25 | 25 | 25 | 25 |
| Extended length 1 (cm) (Load 50 gms) | 40 | 44 | 66 | 55 |
| Extended length 2 (cm) (Load 100 gms | 56 | 56 | 94 | 70 |

The Shore hardness of the silicone rubber material used for the strings under test lay between 30 and 100 and calculations based on these figures resulted in a Young's modulus varying between $7\times10^2$ dynes/cm$^2$ and $12.99\times10^2$ dynes/cm$^2$. As compared, for example, with steel strings having a Young's modulus of $20\times10^{11}$ dynes/cm$^2$ it will be appreciated that the modulus of elasticity of the strings employed in the instrument of the present invention is many orders of magnitude lower and it is the use of such strings which makes it possible to produce a lightweight, unreinforced, instrument having a short scale length. In an alternative embodiment the string diameters are 6 mm, 5.5 mm, 5.00 mm and 4.5 mm respectively, and the joint tension applied by all four strings is just under 10 kg. as described.

Also visible in FIG. 1 are three control knobs 30,31,32 for volume and tone control and a switch 33 which selectively connects or disconnects a passive tone control circuit interposed between the piezo-electric transducer and an amplifier; with the passive tone control circuit switched out of circuit by the switch 33 the transducer is connected directly to an amplifier. As is usual, connection of the instrument to an amplifier can be made via a jack plug socket 34 which can just be seen in FIG. 1.

Figure 2:
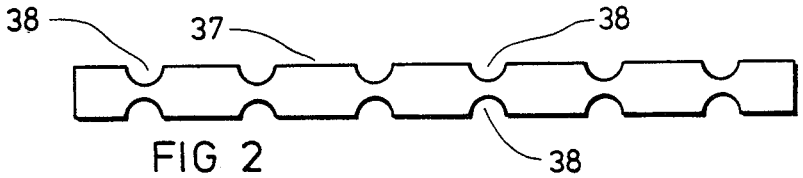
FIG. 2 is a plan view of a component of the bridge illustrated in FIG. 1.
Figure 3:
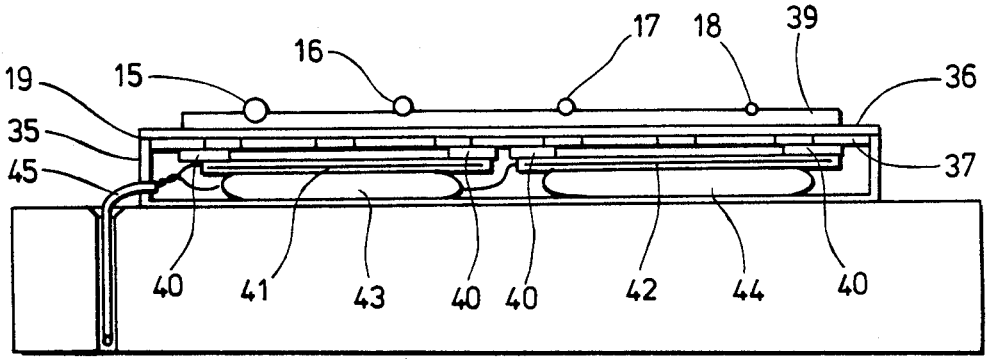
FIG. 3 is a sectional view taken on the line III—III of FIG. 1 illustrating the construction of the combined bridge and pick-up.

Conversion of the mechanical vibrations of the strings 15–18 into electrical signals is effected utilizing a piezo-electric transducer incorporated in the bridge 19. The structure of the bridge 19 is illustrated in cross-section in FIG. 3 where it can be seen that the bridge 19, mounted on the instrument body 13 comprises an outer casing or body member 35 of channel section closed at the top by a cover plate 36 which is secured by adhesive to the channel section base with the interposition of a resilient gasket 37 the shape of which is illustrated in FIG. 2.

The gasket 37 is a flat strip of elastomeric material having a plurality of recesses or notches 38 along each edge such that when applied over the channel section member 35 the recesses 38 give the assembly a high compliance. Over the cover 36 is fitted the bridge saddle member 39 which is contacted by the strings 15–18, illustrated as being housed in appropriately sized recesses although, in practice, the strings may rest directly on a straight upper edge of the bridge saddle member 39. Secured to the underface of the gasket 37 are four mounting pads 40, pairs of which are spanned by respective piezo-electric transducers 41, 42. These transducers 41, 42 are of a twin plate bimorph type and a suitable transducer is that sold by Vernitron Limited and identified by type PZT5B. This comprises a modified lead zirconate titanate ceramic having a high electromechanical coupling coefficient and a high charge sensitivity.

The bimorph structure is one involving a flexing type piezo-electric element consisting of two transverse expander plates secured together face to face and provided with electrodes on the outwardly facing surfaces. Mechanical bending of the element causes a corresponding voltage to be developed between the electrodes. This bimorph construction provides a high overall compliance and capacity, thereby making the transducer extremely sensitive. Such a structure is, however, too delicate to bear directly the forces exerted by a string under tension.

Acoustic coupling of the transducers 41,42 to the channel base 35 is effected by means of malleable resilient acoustic transmission members or beads 43,44. In the specific embodiment a synthetic plastic material is used since this simplifies construction, the beads 43,44 being made slightly oversize and then being plastically deformed as the piezo-electric bimorph transducers 41,42 are pressed down onto them, to be sealed in position by attachment of the cover plate 36. This construction ensures that the vibrations of the strings 15–18 are detected by the transducers 41, 42 and converted into varying voltages which are transmitted via a cable 45 to the passive tone control circuits controlled by the knobs 30–32 and leading to the jack plug socket 34 for connection to an amplifier.

The thickness of the acoustic transmission members 43,44 has been shown slightly greater than that of the support pads 40. In practice, these may be about the same thickness although results may be improved by utilizing thicker support pads 40 and thinner acoustic transmission members 43,44. In any event the thickness of both the support pads 40 and the acoustic transmission members 43,44 should be at least 1 mm to allow sufficient space for flexure of the piezo-electric transducer comprising the transducer elements 41,42.

Figure 4:
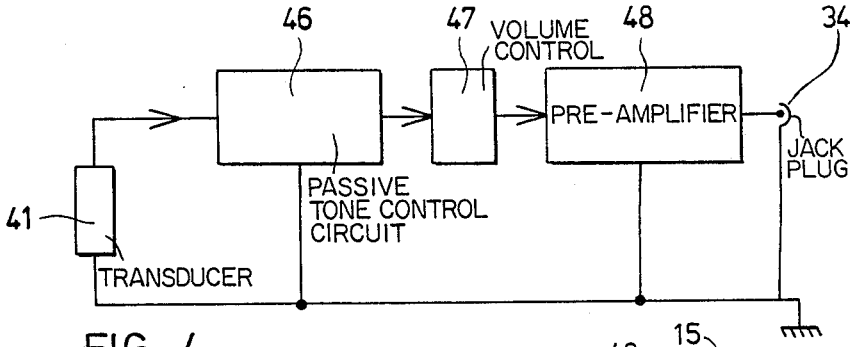
FIG. 4 is a block schematic diagram of the electrical circuit of such an instrument.

The electronic circuits on the instrument itself are shown in FIG. 4. These comprise a high input impedance passive tone control circuit 46 which passes the electrical signal from the transducer 41 to a volume control unit 47 (controlled by the knob 30) from where it is passed to a low gain pre-amp 48 before being applied to the jack plug 34. The pre-amp 48 may have an optional fixed bass boost. In an alternative embodiment (not shown) the pre-amp 48 is dispensed with. The passive tone control circuit 46 is mounted on the instrument body 13 and may be of any known type, particularly incorporating high pass and low pass filters as passive RC circuits for modifying the signal characteristics prior to amplification. If the passive control circuit 46 is not required this can be switched out of circuit by use of the switch 33 (which is not shown in FIG. 4). In a practical embodiment constructed to test the invention it was found that suitable adjustment of the passive control circuit 46 enabled the instrument to produce signals resembling those of a bass guitar or a double bass. Because the tension in the strings 15–18 is low the pressure required on the finger board by the player's fingers is also correspondingly low and this makes it possible for the instrument to be played very rapidly, unlike prior art low note instruments in which relatively high finger pressure and large movements between notes were required, because of the length of the strings. Such large movements between notes made playing the instrument at high speed rather difficult and this is overcome in the instrument of the present invention.

Figure 5:
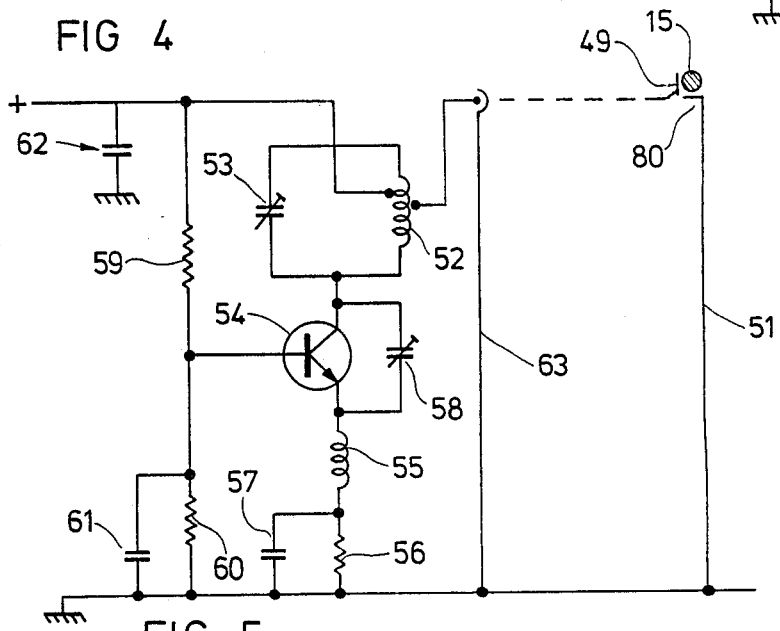
FIG. 5 is a circuit diagram illustrating another embodiment of the invention.

Other structures than those specifically illustrated may be employed. For example, the elastomer of the strings may be impregnated with ferrous material to enable a magnetic transducer to be used. Again, however, the active element of the transducer would be maintained out of contact with the strings. Likewise, with such strings, a capacitative transducer or transducers may be employed, and these may be positioned to detect orthogonal vibrations of the strings. Other types of transducer, including electrostatic types, laser types, and others involving no direct contact with the string may be used. FIG. 5 illustrates an advantageous circuit configuration in which the vibrations of a metal impregnated elastomer string 15 is detected by two orthogonally positioned capacitor plates 49,80, one of which is grounded by line 51 and the other of which is connected to a tapping of an inductance 52 of a resonant oscillator circuit including a variable trimmer capacitor 53 shunted across the inductance 52 and connected, with the inductance 52 to the collector of an NPN transistor 54 the emitter of which is connected to ground through an inductance 55 and parallel connected resistor 56 and capacitor 57. A trimmer capacitor 58 is connected across the collector-emitter junction of the transistor 54, and its base is biased by a voltage divider comprising two series connected resistors 59,60 connected between a positive supply line and the ground line. The resistor 60 is shunted to ground by a capacitor 61. This oscillator circuit generates a high frequency "carrier" signal which can be modulated at audio frequency by the capacitive variations of the plates 49,80 at the frequency of vibration of the string 15. This audio frequency modulated carrier may be transmitted via an antenna schematically indicated 50. The broadcast signal is then received by an appropriately tuned receiver and amplified, modified, etc., in the usual way. Such a system has the considerable advantage of avoiding the necessity for a large number of wires on stage at a performance thereby simplifying the P.A. system very considerably.

What is claimed is:

1. A stringed musical instrument having at least one vibratible string stretched between a first point at one end of the string and a second point at the other end thereof, a bridge over which said at least one string passes, said bridge including:

a bridge body member, a bridge saddle member in direct contact with said string, and means resiliently interconnecting said bridge saddle member and said bridge body member, at least one elongate flexible transducer element having a first end and a second end, resilient transducer mounting means mounting said at least one transducer element on said bridge, said resilient transducer mounting means comprising:

first and second transducer mounts in contact with one face of said at least one transducer element at said first and second ends thereof respectively, and a resilient third transducer mount in contact with the face of said at least one transducer element opposite said one face thereof and intermediate said first and second ends thereof, said resilient third transducer mount being in contact with one of said bridge body member and said bridge saddle member and said first and second transducer mounts being in connection with the other of said bridge body member and said bridge saddle member, and wherein, said at least one string being stretched over said bridge saddle member whereby to apply vibrations of said one string to said saddle member and thence to said at least one transducer element via said resilient transducer mounting means.

2. The stringed musical instrument of claim 1, wherein said at least one string is composed of a homogeneous monolithic elastomeric element.

3. The stringed musical instrument of claim 1 wherein the diameter of said at least one string lies in the range 1.5 to 6 mm when unstressed.

4. The stringed musical instrument of claim 1, wherein the length of said at least one string is in the region of 450 mm.

5. The stringed musical instrument of claim 1, wherein the Shore hardness of said at least one string lies in the range 30 to 100.

6. The stringed musical instrument of claim 1, wherein said string is of substantially circular cross-section throughout its length.

7. The stringed musical instrument of claim 1 wherein there are a plurality of said strings each composed of silicone rubber and stretched over a fingerboard along a neck of said instrument.

8. The stringed musical instrument of claim 1, including an oscillator circuit, and wherein said at least one elastomeric string is impregnated with electrically conductive particles and said at least one transducer element is part of an oscillator circuit generating a carrier frequency signal modulated by the vibrations of said at least one string.

9. A stringed musical instrument comprising an instrument body, a neck projecting from said body, a bridge assembly carried by said instrument body, at least one elastomeric string stretched along said neck and over and in vibrating transmitting contact with said bridge assembly, resilient mounting means within and in vibration receiving contact with said bridge, at least one flexible transducer element, said one flexible transducer element being mounted for flexing movement by said resilient mounting means under influence of vibrations transmitted from said string to said resilient mounting means through said bridge whereby, said one flexible transducer element will generate electrical signals under the influence of vibration of said at least one elastomeric string.

10. The stringed musical instrument of claim 9 wherein said resilient mounting means comprises first means bearing against one face of said transducer element inwardly of said transducer element's two ends with respect to said one face, and second mounting means in contact with an opposite face of said transducer element with respect to the first mentioned face and bearing against said transducer element adjacent the ends of said opposite face in opposition to said first mounting means.

* * * * *